US005806455A

United States Patent [19]

Buzzi

[11] Patent Number: 5,806,455

[45] Date of Patent: Sep. 15, 1998

[54] TRIM ADJUSTING DEVICE FOR PLANING HULL

[76] Inventor: Fabio Buzzi, Via per Lecco, 1-22048 Oggiono (prov. of Lecco), Italy

[21] Appl. No.: 811,408

[22] Filed: Mar. 4, 1997

[30] Foreign Application Priority Data

Mar. 6, 1996 [IT] Italy ..... MI96 A 0437

[51] Int. Cl.[6] ..... B63B 1/22

[52] U.S. Cl. ..... 114/286

[58] Field of Search ..... 114/271, 285, 114/286, 287

[56] References Cited

U.S. PATENT DOCUMENTS

| | | | |
|---|---|---|---|
| 1,779,075 | 10/1930 | Plum . | |
| 1,875,135 | 8/1932 | Plum . | |
| 3,058,442 | 10/1962 | Curtis . | |
| 3,159,131 | 12/1964 | Frederick . | |
| 3,379,158 | 4/1968 | Plum . | |
| 3,463,109 | 8/1969 | Weiler . | |
| 3,589,323 | 6/1971 | Kercheval . | |
| 4,406,635 | 9/1983 | Wuhrer | 114/286 |
| 4,519,336 | 5/1985 | Mason | 114/286 |
| 4,909,175 | 3/1990 | Arnseson | 114/286 |
| 5,193,478 | 3/1993 | Mardikian | 114/285 |
| 5,628,272 | 5/1997 | Thomas | 114/285 |

*Primary Examiner*—Stephen Avila

*Attorney, Agent, or Firm*—Hedman, Gibson & Costigan, P.C.

[57] ABSTRACT

Trim adjusting device for planing hull, also called "flap", the inclination of which is adjusted by control means placed inside the hull. The control means include at least a piston having a vertically moving rod. It is also described a planing hull modified in order to house the flap control means.

8 Claims, 4 Drawing Sheets

TRIM ADJUSTING DEVICE FOR PLANING HULL

INVENTION FIELD

The invention consists of an trim adjusting device for planing hull (hereinafter called "flap"), the inclination of which is modified by control means placed inside the hull. Said control means include at least one piston having a vertically movable rod. A planing hull modified in order to house the flap control means is also described.

BACKGROUND ART

At present, the already known planing hulls (namely the high-speed ones) use flaps (fixed to an hinge positioned at the almost vertical stern board), the inclination of which is adjustable by the user acting fluid operated control means (usually hydraulical and/or pneumatical means), in order to reach an otpimal trim depending on the water surface's conditions on which the hull moves, and to make easier the hull's planing by increasing the hydrodinamic lift on the stern.

The main elements of the known flap control means (hydraulic piston, charge/discharge pipes of the operating fluid, relevant connecting elements etc..) are fixed to the stern board and, therefore, they stay either in the water or in a wet, and (in case of sea water) salty environment. Thus, said main elements present corrosion problems, requiring therefore the use of special, generally expensive materials, and needing a frequent and carefull maintenance; in any case, they can damage the control means reliability.

Furthermore, the stern board is a quite wide, substantially vertical surface, which strongly resists to the reverse motion of the hull and makes the same subjected to wind and to currents. Thus, it is difficult to drive the hull in its reverse motion, specially approaching or leaving a moorage.

The flap of the present invention allows to overcome said drawbacks because its control means elements (hydraulic piston, charge/discharge pipes, connecting elements, etc.), which were previously fixed to the stern board outside the hull, are housed inside the hull, thus being protected from corrosion risks, the piston being fixed to the hull in a substantially vertical position. The new place of the control means and the substantially vertical position of the piston involve that both the means connecting the flap to the free end of the piston rod and the hull stern shape must be modified.

In the described embodiment, the hull stern shape is modified by adding a protruding portion, delimited at the bottom by a sloping surface, the flap control means being positioned inside this protruding portion.

Such protruding portion increases also the stern volume and its positive hydrostatic lift, and make "smoother" the stern, so improving the piercing of the hull into the water during its reverse motion. The sloping surface allows to place the piston of the flap control means in a substantially vertical position and to minimize the stern board height in order to house the different propulsion means (water-jet propellers, submerged propellers, surface propellers etc.) which are suitable to be installed inside the hull.

SUMMARY OF THE INVENTION

It is object of the present invention a planing hull flap operated by control means which are positioned inside the hull and which include at least one piston fixed to the hull in a substantially vertical position.

The control means are positioned inside a protruding portion fixed to the hull stern board and delimited at the bottom by a sloping surface to which the control means piston is fixed. The flap includes:

at least one pair of supports having an end hinged to the sloping surface. The supports bear the operating surface of the flap, the inclination of which is adjusted by the piston acting on said pair of supports;

means connecting the free end of the piston rod with said pair of supports.

DESCRIPTION OF THE DRAWINGS

The invention will be better described by reference to the following drawings, given as a non-limitative example of a preferred embodiment, in which.

In the annexed drawings, corresponding elements are always identified by the same reference numbers.

DETAILED DESCRIPTION OF THE DRAWINGS

Figure 1:
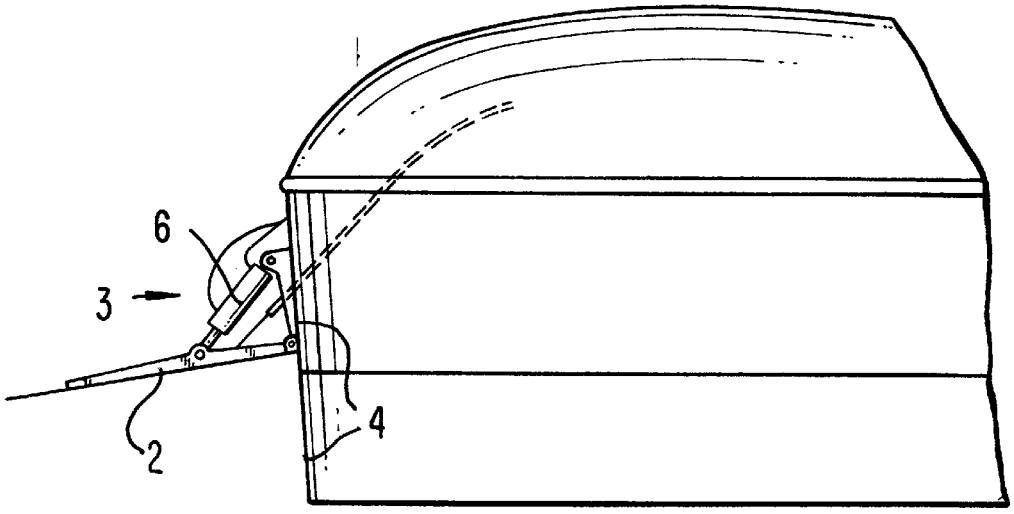
FIG. 1 schematically shows the stern of a planing hull having conventional flaps.

FIG. 1 schematically shows the stern of a planing hull having conventional flaps: in FIG. 1 there are shown one of the flaps 2 (hinged to the stern board 4) and control means 3 (including at least one hydraulic and/or pneumatic piston 6) which enable the user to adjust the inclination of the flap 2 of FIG. 1. Control means 3 are fixed to the outside of the stern board 4 of the hull. The hinge of the flap 2 (not described because of conventional type) and the control means 3 are fixed to the stern board (4) in a conventional way, for example by staybolts.

In FIG. 1, in order to simplify the drawing, the propulsion means installed inside the hull, the second flap 2 and the respective control means 3 are omitted. As already known, the planing hulls are generally provided with pairs of flaps installed simmetrically to the propulsion means.

Figure 2:
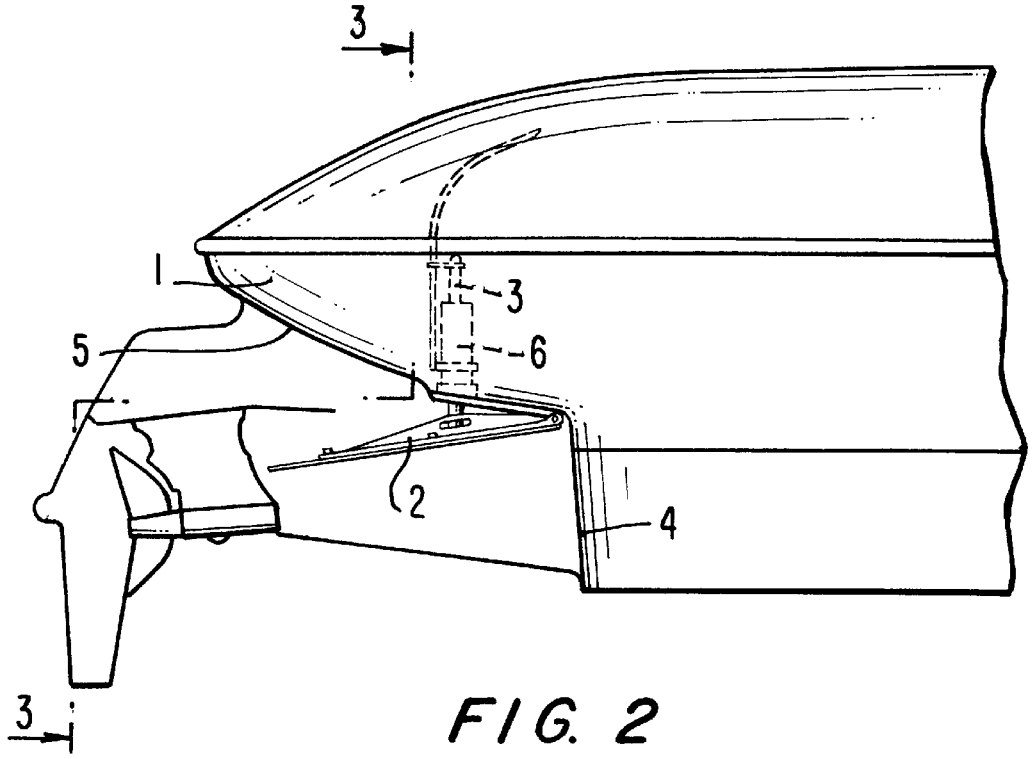
FIG. 2 schematically shows the stern of a planing hull having flaps according to the invention.

FIG. 2 shows the stern of a planing hull having flaps according to the invention; in FIG. 2 one of the flaps 2 and the protruding portion 1 are shown. The protruding portion 1 is applied to the rear end of the hull and the piston 6 and the other elements of the control means 3 of the flap 2 are housed inside this protruding portion 1. The flap 2 is hinged in a conventional way to the hull, and the control means 3 (shown in FIG. 2 by dotted/lines) are therefore protected against any corrosion risks.

The protruding portion 1 is delimited at the bottom by the sloping surface 5 allowing to minimize the stern board 4 height needed to install the propulsion means schematically shown in FIG. 2. Said protruding portion 1 widely improves the handling manoeuvrability of the hull during its reverse motion and the stern lift and floating on displacement.

Figure 6:
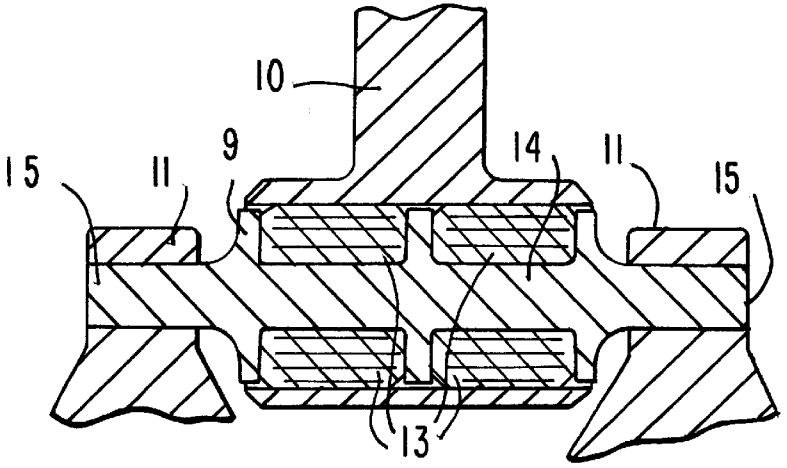
FIG. 6 shows a sectional view of the connecting means of the piston rod 10 with a pair of supports 11.

In FIG. 2, flap 2 is hinged in a conventional way to the sloping surface 5; piston 6 is placed inside the protruding portion 1, has a substantially vertical position and is fixed in a conventional way to the sloping surface 5. The free end of the piston rod 10 is connected to flap 2 by connecting means according to the invention, as shown in FIGS. 4–6.

Figure 3:
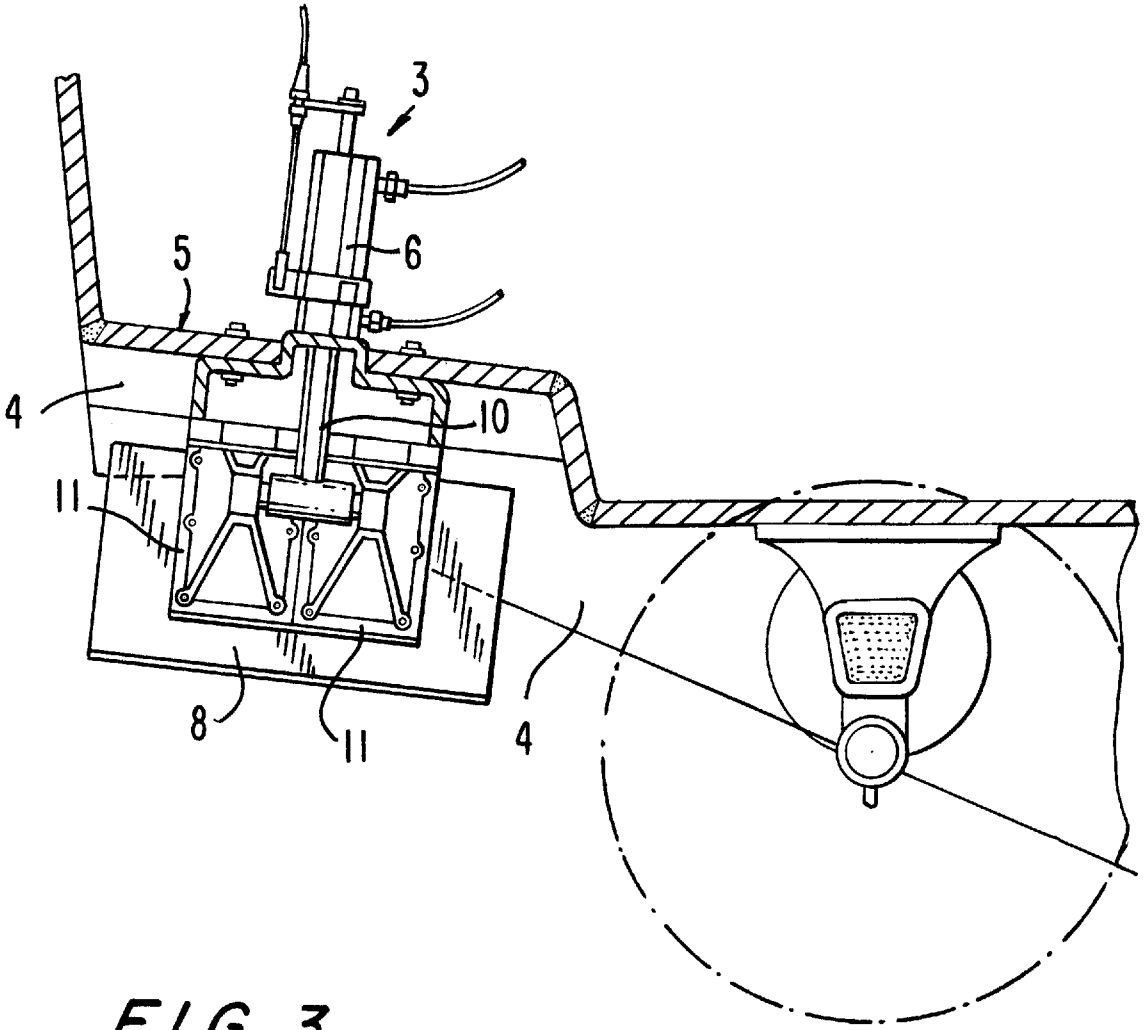
FIG. 3 is a rear partial view of the hull of FIG. 2 according to the section plan III—III of FIG. 2.

FIG. 3 shows a partial rear view of the hull of FIG. 2, according to section plane III—III of FIG. 2. In FIG. 3 there are shown the bottom part of the hull and specifically the stern board 4 having considerably reduced dimensions, the sloping surface 5 (in section), a support of the propulsion means and the propeller shaft of the same propulsion means.

The control means 3 and the hinge around which the supports 11 of flap 2 rotate (they are better shown in FIG. 5) are fixed in a conventional way to the sloping surface 5. Flap 2 has at least one pair of supports 11 bearing the active surface 8 of the same flap and which are connected by connecting means (FIGS. 4–6) to the free end of the rod 10 of piston 6, the vertical motion of said rod adjusting the inclination of the active surface 8 of flap 2.

Figure 4:
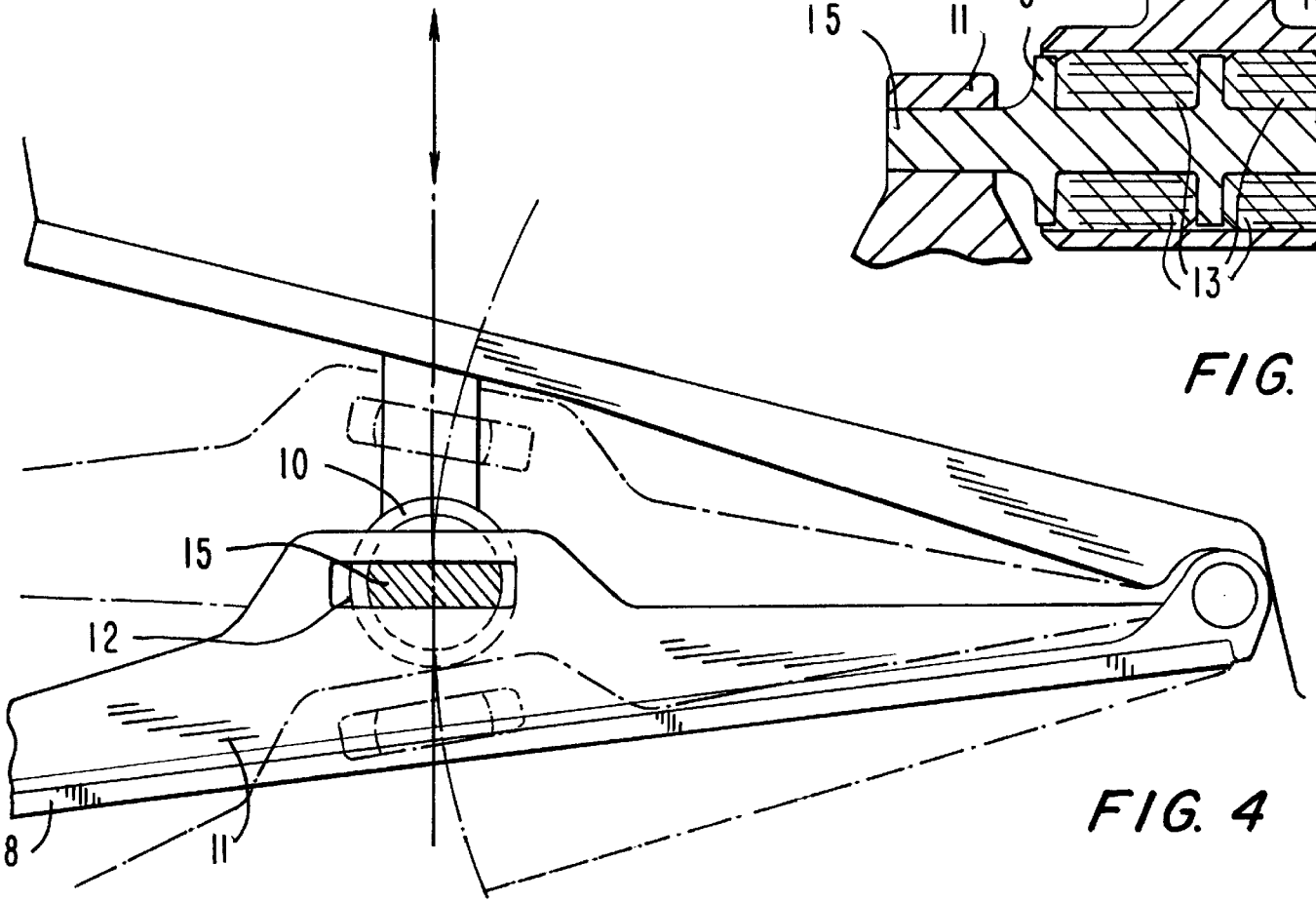
FIG. 4 schematically shows an enlarged lateral partial view of the flap 2.
Figure 5:
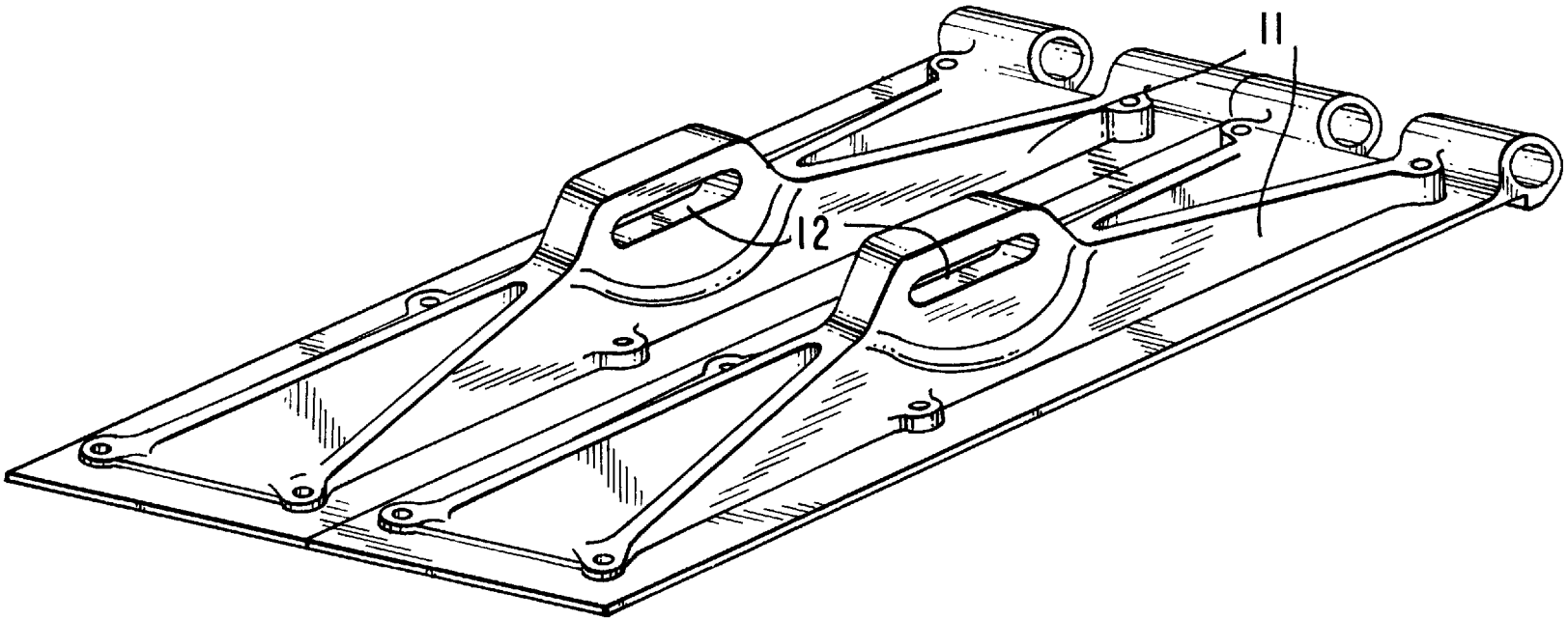
FIG. 5 shows a prospectic view of a pair of supports 11 of the flap 2.

FIG. 4 schematically shows an enlarged partial lateral view of a flap, the active surface 8 of which is fixed to a support 11 hinged (in a conventional way) to the sloping surface 5 from which the free end of the piston rod 10 protrudes. The vertical motion of the rod 10, pointed out in FIG. 4 by a pair of opposing arrows, adjusts the inclination of the flap 2.

Means suitable to couple the linear motion of the free end of the piston rod 10 with the circular motion of the flap 2 include a sliding skid 9 (FIG. 6) having a central portion 14 suitable to be fitted into the free end of piston rod 10 and two identical lateral portions 15, each of which is suitable to be fitted into a flat central cavity 12 of support 11, better shown in FIG. 5. The central portion 14 of skid 9 can rotate relatively to the free end of rod 10.

In FIG. 4 the positions of the flap 2 are shown by fragmented lines, when piston 6 is respectively at the upper and the lower end of its stroke.

FIG. 6 is a sectional view of the free end of the rod 10 of piston 6, connected by the skid 9 to a pair of supports 11. In the figure are shown the central portion 14 of skid 9, which is fitted into the free end of the rod 10 of piston 6, and the two identical lateral portions 15, each of which is fitted into the flat central cavity 12 of a support 11 (not shown in FIG. 6 because it houses the corresponding lateral portion 15 of the skid 9).

In FIG. 6 the elastic means 13 are also shown, which are placed between the central portion 14 of the skid 9 and the free end of rod 10 of the piston 6 in order to damp and gradually transmit to the rod 10 possible shocks and/or mechanical stresses.

Elastic means 13 constist preferably (but not compulsory) of four half-moon shaped bodies of an elastic material.

In the preferred embodiment shown in the annexed drawings, the dimensions of the active surface 8 of flap 2 are so reduced that it is possible to adjust the inclination of flap 2 by only one piston 6 which is connected to a pair of supports 11 (as already described). When the active surface 8 dimensions are so big that it is impossible to adjust the flap inclination by one only piston 6, according to the present invention the flap inclination can be adjusted by placing side by side two or more control means 3, each of them including a piston 6 connected (as already described) to a pair of supports 11, or control means 3 including two or more pistons 6 each of them being connected (as already described) to a pair of supports 11.

Within the scope of the invention, as a consequence of the common experience and of the technical development, it is also possible to a skilled man to modify and to improve the trim adjusting device for planing hull to which the present description refers.

I claim:

1. Trim adjusting device for a planing hull, said planing hull including a protruding portion; and said trim adjusting device being hinged to the stern end of said planing hull beneath said protruding portion; and said trim adjusting device being operated by control means positioned inside said hull and comprising at least one piston fixed to said hull in a substantially vertical position; and said control means being positioned inside said protruding portion fixed to the rear end of said hull.

2. Device according to claim 1, wherein said protruding portion is delimited at the bottom by a sloping surface and that said at least one piston of said control means is fixed to said sloping surface in a substantially vertical position.

3. Device according to claim 1, being operated by at least two control means placed inside said hull, each of said at least two control means comprising a piston.

4. Device according to claim 1, wherein said control means placed inside said hull comprise at least two pistons.

5. Trim adjusting device for a planing hull, being operated by control means positioned inside said hull and comprising at least one piston fixed to said hull in a substantially vertical position; and said control means being positioned inside a protruding portion fixed to the rear end of said hull; said trim adjusting device including:

at least one pair of supports having an end hinged to said hull and capable to bear the active surface of said trim adjusting device, the inclination of said active surface being adjusted by said at least one piston of said control means on said at least one pair of supports;

connecting means capable to connect the free end of the rod of said at least one piston with said at least one pair of supports.

6. Device according to claim 5, characterized in that one end of said supports of said at least one pair of supports is hinged to said sloping surface of said protruding portion.

7. Trim adjusting device for a planing hull, being operated by control means positioned inside said hull and comprising at least one piston fixed to said hull in a substantially vertical position; and including:

at least one pair of supports having an end hinged to said hull and capable to bear the active surface of said trim adjusting device, the inclination of said active surface being adjusted by said at least one piston of said control means acting on said at least one pair of supports;

connecting means capable to connect the free end of the rod of said at least one piston with said at least one pair of supports; and said connecting means include a sliding skid, having a central portion suitable to be fitted into said free end of said rod of said at least one piston and rotating relatively to said free end of said rod, and two identical lateral portions each of which is suitable to be fitted into a flat central cavity of one of said supports of said at least one pair of supports.

8. Device according to claim 7, wherein said connecting means include elastic means placed between said central portion of said skid and said free end of said rod of said at least one piston.

* * * * *